US007430832B2

(12) United States Patent
Hung

(10) Patent No.: US 7,430,832 B2
(45) Date of Patent: Oct. 7, 2008

(54) SLIDING DOOR HAVING AUTOMATIC CLOSING STRUCTURE

(76) Inventor: Si Chien Hung, No. 557, Sec. 7, Ersi Road, Erlin Town, Changhua Hsien 526 (TW)

( * ) Notice: Subject to any disclaimer, the term of this patent is extended or adjusted under 35 U.S.C. 154(b) by 222 days.

(21) Appl. No.: 10/947,474

(22) Filed: Sep. 22, 2004

(65) Prior Publication Data

US 2006/0230683 A1 Oct. 19, 2006

(51) Int. Cl.
*E05D 15/06* (2006.01)

(52) U.S. Cl. ..... 49/404; 49/409; 49/425; 16/72

(58) Field of Classification Search ..... 49/404, 49/409, 425, 447, 445, 347, 324; 16/72, 16/194, 193
See application file for complete search history.

(56) References Cited

U.S. PATENT DOCUMENTS 1,008,987 A * 11/1911 Prouty ..... 49/425
1,176,152 A * 3/1916 Lawrence ..... 16/105
1,274,279 A * 7/1918 Kinghan ..... 49/372
3,978,617 A * 9/1976 Eventoff ..... 49/404
4,004,372 A * 1/1977 Beard et al. ..... 49/404
4,330,960 A * 5/1982 Hasemann et al. ..... 49/404
4,641,461 A * 2/1987 Niekrasz et al. ..... 49/404
4,799,528 A 1/1989 Benitez
5,065,807 A 11/1991 Maeda et al.
5,085,261 A 2/1992 Bortoluzzi
5,131,188 A * 7/1992 Hutchison et al. ..... 49/404
5,203,116 A * 4/1993 Chen ..... 49/404
5,251,402 A * 10/1993 Richardson et al. ..... 49/404
5,313,739 A * 5/1994 Nelson et al. ..... 49/404
5,720,080 A * 2/1998 Rose ..... 16/74
5,850,672 A * 12/1998 Dalton ..... 16/81
6,324,727 B1 * 12/2001 Ortoleva et al. ..... 16/94 R
6,446,394 B1 * 9/2002 Finke et al. ..... 49/409

* cited by examiner

*Primary Examiner*—Gregory J. Strimbu
(74) *Attorney, Agent, or Firm*—Charles E. Baxley

(57) ABSTRACT

A sliding door includes a track having a longitudinal channel to slidably receive a carrier, a door panel secured to the carrier, a bracket attached to one end portion of the track and having a pathway and a pulley, and a recovering device having a cable. The cable has one end secured to the track, and a middle portion slidably engaged through the pathway of the bracket, and the other end secured to the carrier. The door panel and the carrier are movable along the track, and the cable is engageable around the pulley of the bracket, to bias and to force the door panel and the carrier backward toward the one end portion of the track when the door panel is released. One or more spring members may be engaged in the cable.

12 Claims, 5 Drawing Sheets

SLIDING DOOR HAVING AUTOMATIC CLOSING STRUCTURE

BACKGROUND OF THE INVENTION

1. Field of the Invention

The present invention relates to a sliding door, and more particularly to a sliding door having a spring biasing device for recovering door panels automatically.

2. Description of the Prior Art

Typical sliding doors or folding doors or other closure door devices comprise a number of door panels slidably attached to upper and lower tracks with wheels or rollers, to allowing the door panels to slide along the upper and the lower tracks freely.

For example, U.S. Pat. No. 4,799,528 to Benitez, and U.S. Pat. No. 5,065,807 to Maeda et al. disclose two of the typical sliding doors or folding doors or other closure door devices each also comprising a number of door panels slidably attached to upper and lower tracks with roller bearings. However, after opening or moving the door panels, the users have also to move the door panels back to the original positions manually.

U.S. Pat. No. 5,085,261 to Bortoluzzi discloses another typical sliding door or folding door comprising a number of foldable accordion door panels slidably attached to tracks with roller bearings, and return springs coupled between lugs of spacer elements. However, the return springs are directly coupled between the lugs of the spacer elements of the door panels, such that the moving strokes of the door panels are limited by the stretchability or extensibility of the return springs.

For example, when the return springs are made stronger, the stretchability or extensibility of the return springs will be greatly decreased. On the contrary, when the return springs are made weaker, the stretchability or extensibility of the return springs may be increased, but the door panels may not be suitably recovered by the return springs.

The present invention has arisen to mitigate and/or obviate the afore-described disadvantages of the conventional sliding doors or folding doors.

SUMMARY OF THE INVENTION

The primary objective of the present invention is to provide a sliding door including a spring biasing device for recovering door panels automatically, and for allowing the door panels to be easily operated by the users.

In accordance with one aspect of the invention, there is provided a sliding door comprising a track including a longitudinal channel formed therein, and including a first end portion and a second end portion, a carrier slidably received in the longitudinal channel of the track, a door panel secured to the carrier and movable in concert with the carrier along the track, a first bracket attached to the second end portion of the track, and including a pathway formed therein, and including a pulley rotatably attached thereto, and a recovering device including a cable having a first end secured to the first end of the track, and having a middle portion slidably engaged through the pathway of the first bracket, and having a second end secured to the carrier. The door panel and the carrier are movable along the track against the cable and movable from the second end portion toward the first end portion of the track, and the cable is engageable around the pulley of the first bracket, to recover and to force the door panel and the carrier backward toward the second end portion of the track when the door panel is released.

The track includes at least one longitudinal groove formed therein to receive the cable therein. The recovering device includes at least one spring member engaged in the cable, and received in the longitudinal groove of the track.

The track includes at least one narrowed longitudinal slit formed therein, and communicated between the longitudinal groove and the longitudinal channel of the track. The track includes an upper wall having the longitudinal groove formed therein. The first bracket includes an extension extended therefrom and engaged into the longitudinal groove of the track.

The track includes at least one lower flange extended into the longitudinal groove thereof, and a cap engaged in the first end of the track and engaged with the flange. The cap includes a lock notch formed therein and defined between two ears.

The door panel includes a cavity formed therein, the carrier includes a block secured thereto and engaged into the cavity of the door panel, and secured to the door panel. The block includes at least one screw hole formed therein, and a fastener engaged through the door panel, and threaded into the screw hole of the block, to secure the block to the door panel.

The block includes at least one slot formed therein and communicating with the screw hole thereof. The track includes a second bracket attached to the first end portion of the track, and the second end of the cable is secured to the second bracket.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
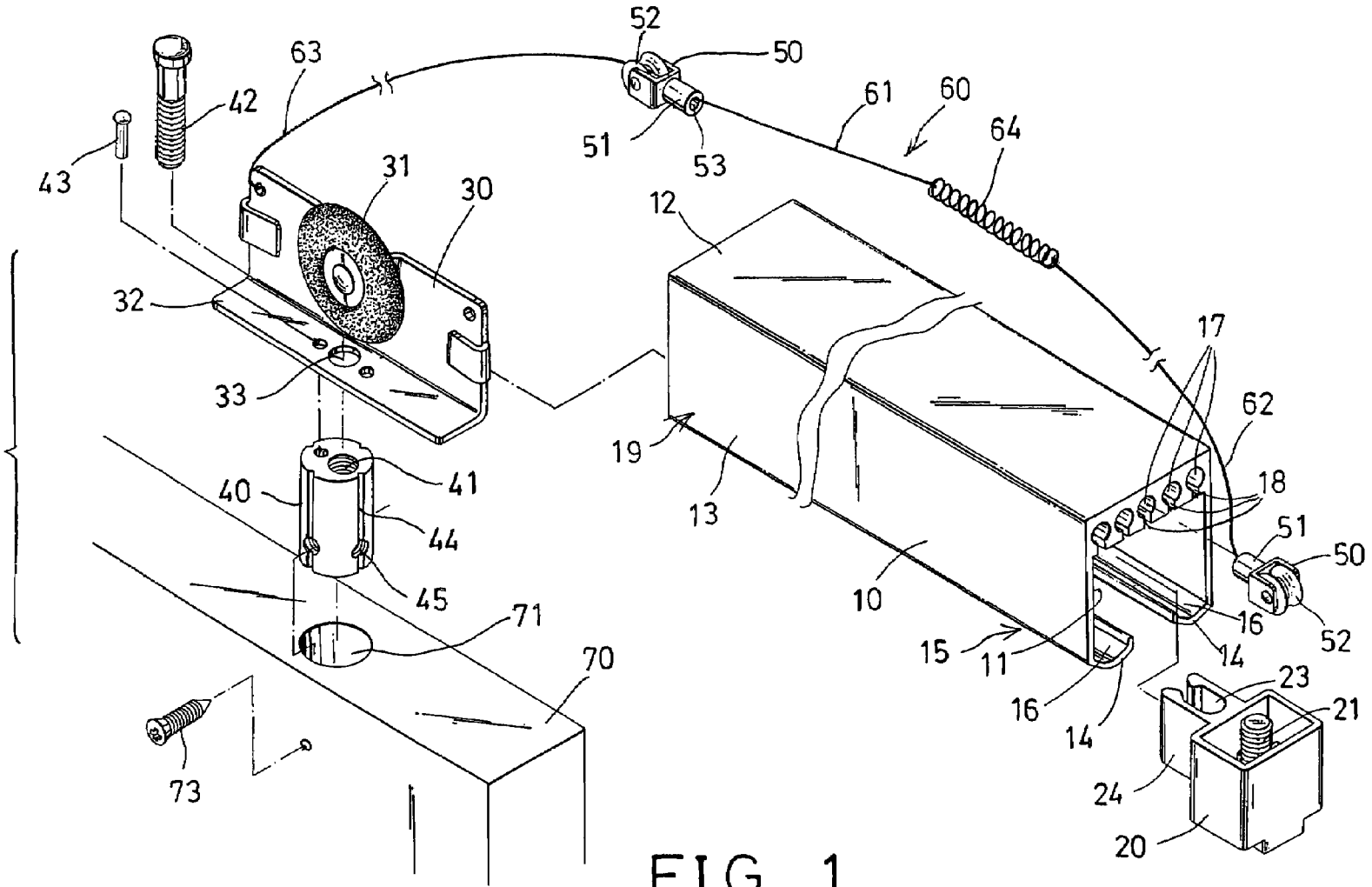
FIG. 1 is an exploded view of a sliding door in accordance with the present invention.

Referring to the drawings, and initially to FIGS. 1-4, a sliding door in accordance with the present invention comprises a track 10, such as an upper track 10 including a longitudinal channel 11 formed therein and defined by an upper wall 12 and two side walls 13, and including one or more, such as two flanges 14 extended inwardly from lower portions of the side walls 13 respectively and spaced away from each other. Each of the flanges 14 is preferably curved downwardly or includes a recess 16 formed in the upper portion thereof.

The track 10 further includes one or more longitudinal grooves 17 formed therein, such as formed in the upper wall 12 thereof, and one or more narrowed longitudinal slits 18 formed therein, such as formed in the upper wall 12 thereof, and formed or located between the longitudinal grooves 17 and the longitudinal channel 11 of the track 10, to allow the longitudinal grooves 17 to be communicated with the longitudinal channel 11 of the track 10.

A cap 20 may be disposed or engaged in one end 15 of the longitudinal channel 11 or of the track 10, and may be engaged or anchored between the upper wall 12 and the lower flanges 14, and may be releaseably secured to the one end 15 of the track 10 with one or more fasteners 21, in order to block the one end of the track 10. The cap 20 includes a lock notch 23 formed therein and defined between two ears 24.

A truck or carrier 30 is slidably received in the longitudinal channel 11 of the track 10, and includes one or more wheels or rollers 31 attached thereto, and engaged on the flanges 14 of the track 10, and stably retained in the recess 16 of the flange 14 (FIGS. 3, 7), to smoothly attach the carrier 30 to the track 10, and to allow the carrier 30 to freely and smoothly slide along the track 10 and moveable between the end portions 15, 19 of the track 10.

Figure 3:
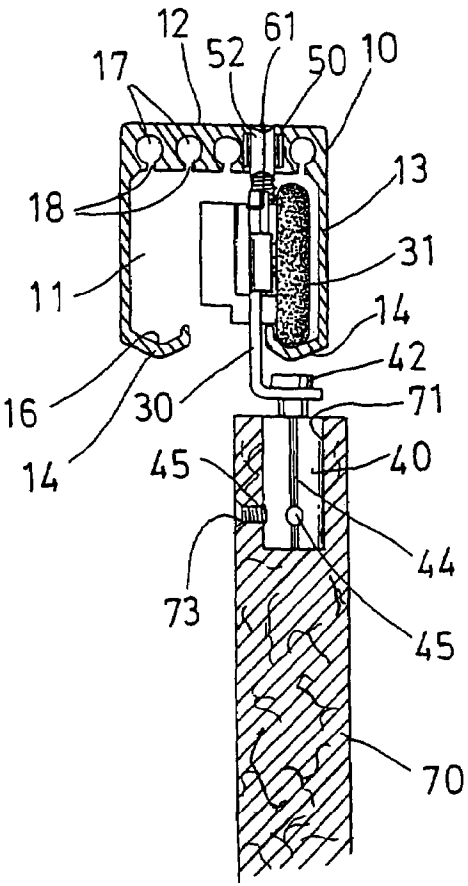
FIG. 3 is a partial cross sectional view of the sliding door, taken along lines 3-3 of FIG. 2.
Figure 7:
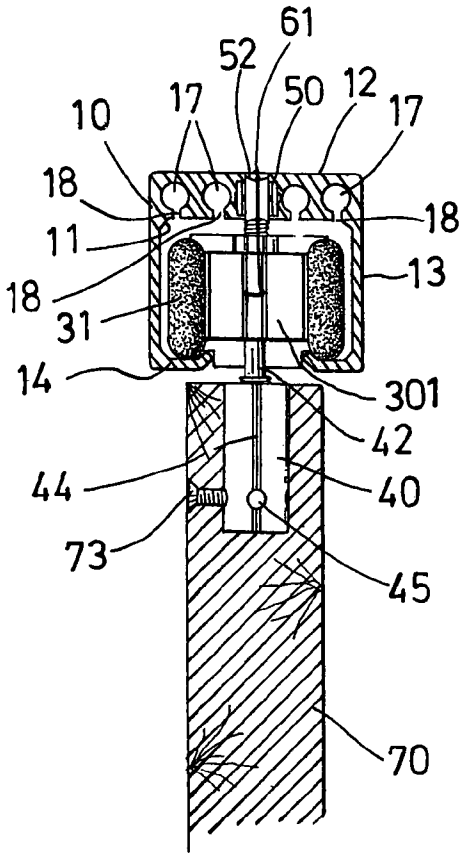
FIG. 7 is a partial cross sectional view of the sliding door, taken along lines 7-7 of FIG. 5.
Figure 6:
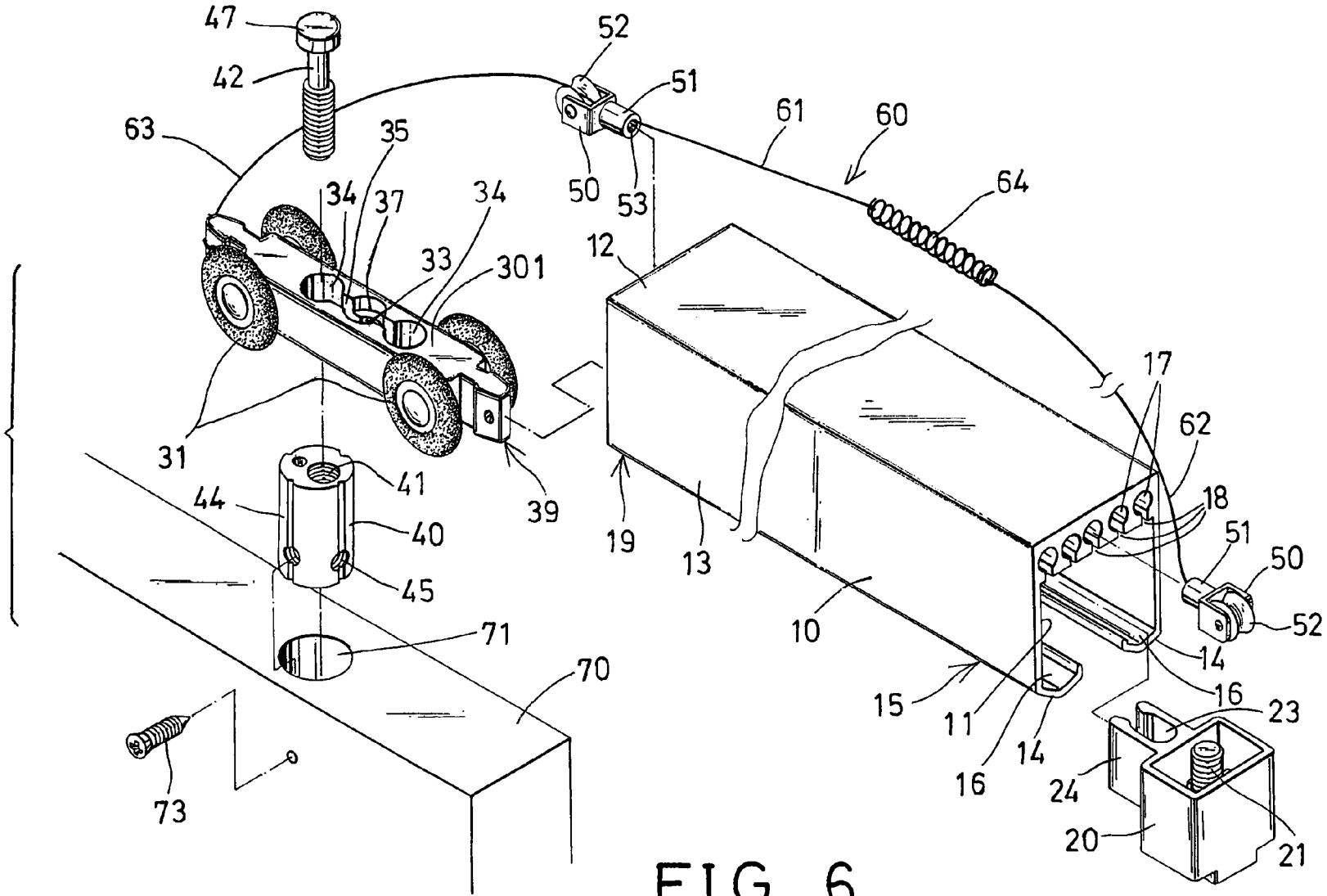
FIG. 6 is an exploded view of the sliding door as shown in FIG. 5.

For example, as shown in FIGS. 1 and 3, the carrier 30 may include only one roller 31 attached to one side thereof and engaged on one of the flanges 14 of the track 10. However, as shown in FIGS. 6-7, the carrier 30 may also include one or more rollers 31 attached to each side thereof and engaged on the respective flanges 14 of the track 10, to allow the carrier 30 to be smoothly engaged or attached to the track 10. The carrier 30 includes a panel 32 laterally extended from the bottom portion thereof (FIGS. 1, 3) and having an orifice 33 formed therein.

A block 40 is disposed below the panel 32 of the carrier 30, and includes a screw hole 41 formed therein, and aligned with the orifice 33 of the panel 32 of the carrier 30, for receiving or threading with a fastener 42 which may secure the block 40 to the carrier 30. One or more further fasteners or rivets 43 may further be provided and engaged through the panel 32 of the carrier 30 and engaged into the block 40, in order to further solidly secure the block 40 to the carrier 30.

The block 40 may be engaged into a cavity 71 of a door panel 70, and may include one or more slots 44 vertically formed in the outer peripheral portion thereof, and one or more screw holes 45 formed in the outer peripheral portion thereof and preferably communicating with the slots 44 thereof respectively, for receiving or threading with a screw or fastener 73 which may secure the block 40 to the door panel 70 (FIGS. 3, 7), and thus may secure the carrier 30 to the door panel 70, and thus for allowing the door panel 70 to be slidably attached to the track 10 with the carrier 30.

One or more brackets 50, such as a first and a second brackets 50 each may include an extension 51 extended therefrom and engaged into the end portions 15, 19 of the respective longitudinal grooves 17 of the track 10, to anchor or position the brackets 50 to the track 10 (FIGS. 2, 4-5), and each may include a pulley 52 rotatably attached thereto. One of the brackets 50 may include a pathway 53 formed in the extension 51 thereof (FIGS. 1, 6) for slidably receiving a resilient or extendible cable 61 of a recovering device 60.

For example, the cable 61 of the recovering device 60 may have one end 62 secured to the bracket 50 that is located at the one end 15 of the track 10 and preferably located close to the cap 20, or directly secured to the one end 15 of the track 10, and may have a middle portion engaged through the pathway 53 of the other bracket 50 and engaged over the pulley 52, and may have the other end 63 secured to the carrier 30. The cable 61 of the recovering device 60 may include a suitable resilience or extensibility, in order to bias or to recover the carrier 30 relative to the track 10.

It is preferable that the recovering device 60 further includes one or more spring members 64, such as coil spring members 64 attached or engaged in the cable 61, and also having suitable resilience or extensibility, in order to increase the spring biasing force and/or extensibility and/or stretchability of the recovering device 60, and so as to facilitate the recovering of the carrier 30 relative to the track 10.

It is preferable that the spring members 64 include an outer diameter smaller than that of the longitudinal grooves 17 of the track 10, but greater than the width of the narrowed longitudinal slits 18 of the track 10, to allow the spring members 64 and the cable 61 to be retained within the longitudinal grooves 17 of the track 10, and thus to position the spring members 64 to the track 10, and to prevent the spring members 64 from being engaged into the longitudinal channel 11 of the track 10.

Figure 2:
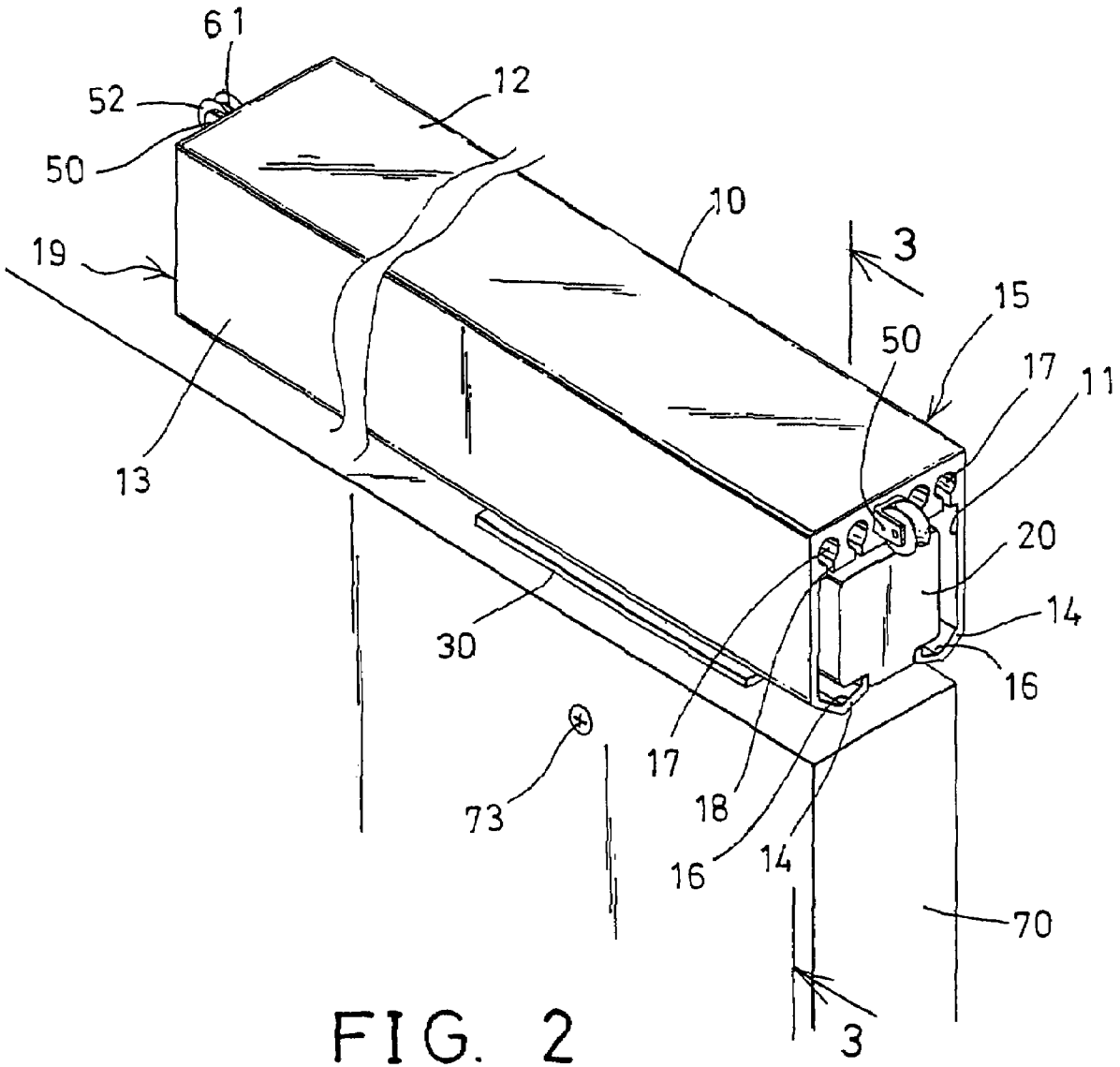
FIG. 2 is a partial perspective view of the sliding door.
Figure 4:
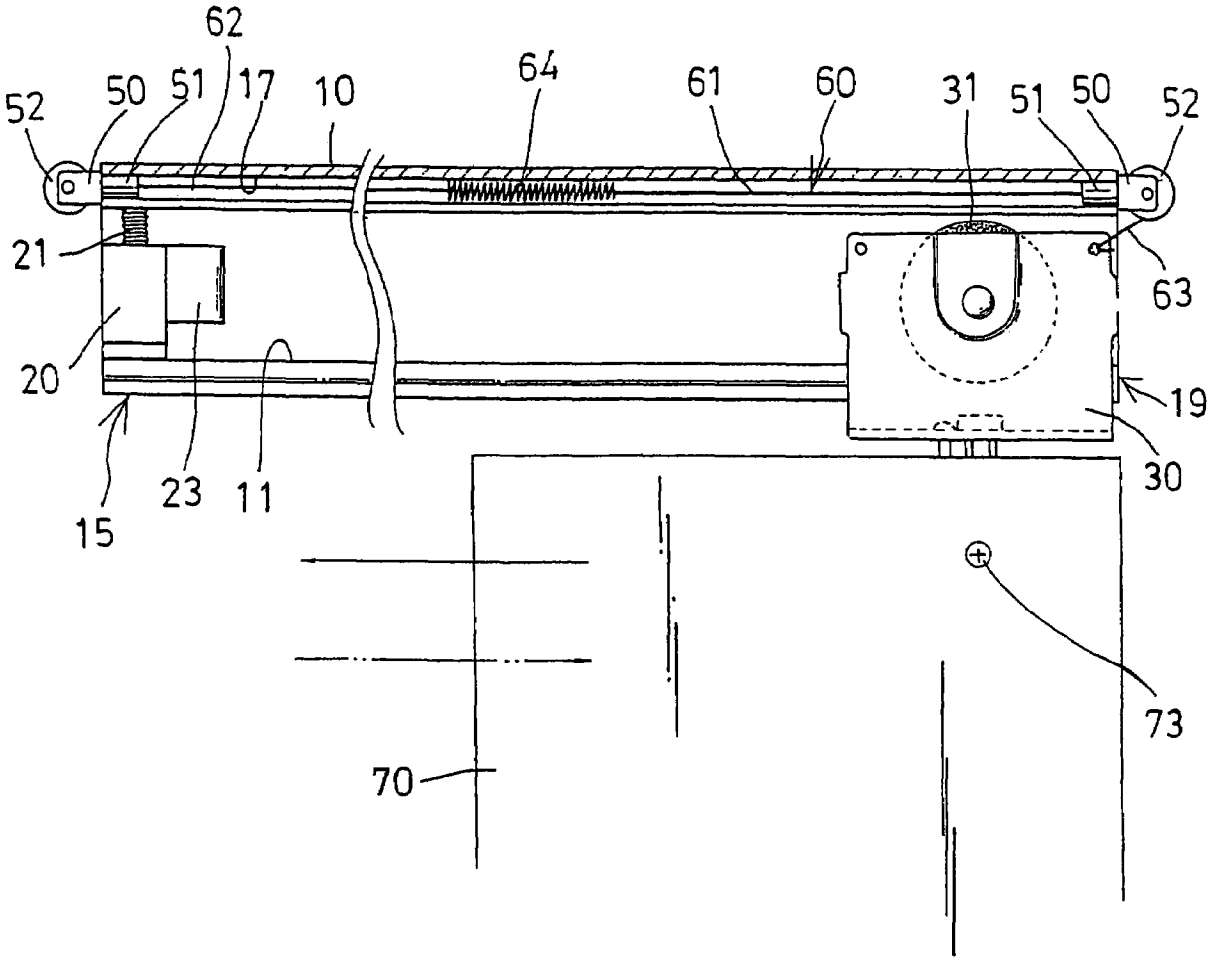
FIG. 4 is a front plan view of the sliding door, illustrating the operation of the sliding door.
Figure 5:
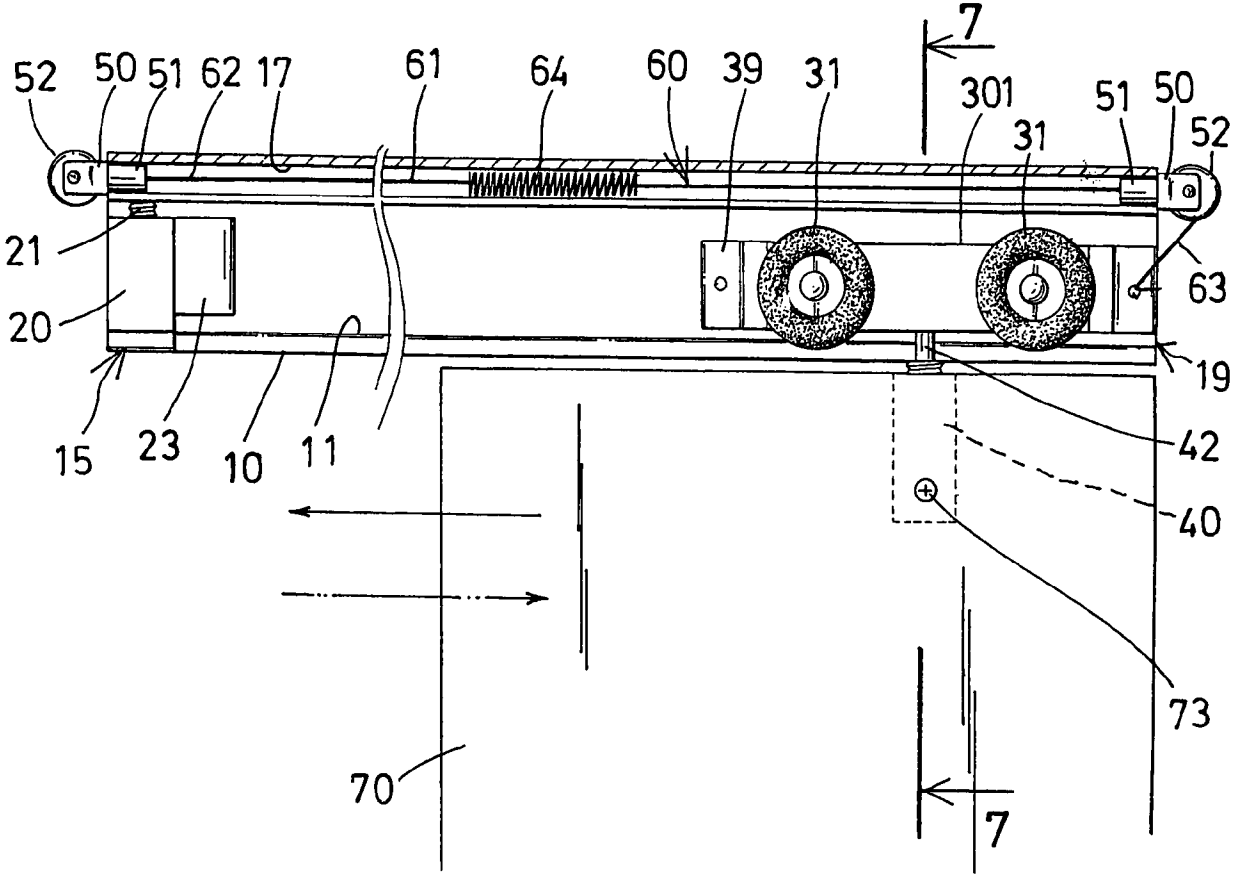
FIG. 5 is a front plan view similar to FIG. 4, illustrating the other embodiment of the sliding door.

In operation, as shown in FIGS. 2-4, when the door panel 70 is moved relative to the track 10, the carrier 30 may be forced to move along the longitudinal channel 11 of the track 10, or from the other end portion 19 toward the one end portion 15 of the track 10, against the resilient cable 61 and/or the spring members 64. The cable 61 may be moved around the pulley 52 of the other bracket 50 that is located at the other end portion 19 of the track 10, to allow the carrier 30 to be moved along the track 10 to a greater moving stroke.

When the door panel 70 is released by the users, the cable 61 and/or the spring members 64 may bias or force the carrier 30 and thus the door panel 70 backward toward the other end portion 19 of the track 10.

As shown in FIG. 6, the carrier 301 may further include one or more apertures 34 formed therein and located beside the orifice 33 thereof, and one or more narrowed passageways 35 formed between the orifice 33 and the apertures 34 thereof, for communicating the orifice 33 and the apertures 34 with each other, and for allowing the fastener 42 to be moved between the orifice 33 and the apertures 34.

The carrier 301 may further include an enlarged opening 35 formed therein and located above and communicating with the orifice 33 thereof. The fastener 42 may include an enlarged head 47 engageable into the enlarged opening 35 of the carrier 301, but the enlarged head 47 includes a diameter greater than the width of the narrowed passageways 35 of the carrier 301 but no greater than the inner diameters of the apertures 34 of the carrier 301. The carrier 301 may include a catch 39 provided on one end thereof (FIG. 6) for engaging into the lock notch 23 of the cap 20, to position the door panel 70 and the carrier 301 to the first end 15 of the track 10.

Accordingly, the sliding door in accordance with the present invention includes a spring biasing device for recovering door panels automatically, and for allowing the door panels to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sliding door comprising:

a track including a longitudinal channel formed therein, and including a first end portion and a second end portion, a carrier slidably received in said longitudinal channel of said track, a door panel secured to said carrier and movable in concert with said carrier along said track, a first bracket attached to said second end portion of said track, and including a pathway formed therein, and including a pulley rotatably attached thereto, a cable having a first end secured to said first end portion of said track, and having a middle portion slidably engaged through said pathway of said first bracket, and having a second end secured to said carrier, said cable including at least one in-line spring member connecting two parts of said cable together, and said door panel and said carrier being movable along said track and movable from said second end portion toward said first end portion of said track, and said cable being engageable around said pulley of said first bracket, and said at least one spring member being provided to bias and to force said door panel and said carrier backward toward said second end portion of said track after said door panel and said carrier are moved from said second end portion toward said first end portion of said track and when said door panel is released.

2. The sliding door as claimed in claim 1, wherein said track includes at least one longitudinal groove formed therein to receive said cable therein.

3. The sliding door as claimed in claim 2, wherein said at least one spring member is received in said at least one longitudinal groove of said track.

4. The sliding door as claimed in claim 2, wherein said track includes at least one narrowed longitudinal slit formed therein and located between said at least one longitudinal groove and said longitudinal channel of said track, and said at least one narrowed longitudinal slit of said track is communicating with said at least one longitudinal groove and said longitudinal channel of said track.

5. The sliding door as claimed in claim 2, wherein said track includes an upper wall having said at least one longitudinal groove formed therein.

6. The sliding door as claimed in claim 2, wherein said first bracket includes an extension extended therefrom and engaged into said at least one longitudinal groove of said track.

7. The sliding door as claimed in claim 2, wherein said track includes at least one lower flange extended into said longitudinal channel thereof, and a cap engaged in said first end portion of said track and engaged with said at least one flange.

8. The sliding door as claimed in claim 7, wherein said cap includes a lock notch formed therein and defined between two ears.

9. The sliding door as claimed in claim 1, wherein said door panel includes a cavity formed therein, said carrier includes a block secured thereto and engaged into said cavity of said door panel, and secured to said door panel.

10. The sliding door as claimed in claim 9, wherein said block includes at least one screw hole formed therein, and a fastener engaged through said door panel, and threaded into said at least one screw hole of said block, to secure said block to said door panel.

11. The sliding door as claimed in claim 10, wherein said block includes at least one slot formed therein and communicating with said at least one screw hole thereof.

12. The sliding door as claimed in claim 1, wherein said track includes a second bracket attached to said first end portion of said track, and said first end of said cable is secured to said second bracket.

* * * * *